US011834324B2

(12) United States Patent
Liang et al.

(10) Patent No.: US 11,834,324 B2
(45) Date of Patent: Dec. 5, 2023

(54) DEVICE AND METHOD FOR MANUFACTURING POCKET SPRING BED NET

(71) Applicant: GUANGZHOU LIANROU MACHINERY & EQUIPMENT CO., LTD., Guangzhou (CN)

(72) Inventors: Jie Liang, Guangzhou (CN); Zhiming Tan, Guangzhou (CN); Zhiliang Tan, Guangzhou (CN)

(73) Assignee: GUANGZHOU LIANROU MACHINERY & EQUIPMENT CO., LTD., Guangzhou (CN)

( * ) Notice: Subject to any disclaimer, the term of this patent is extended or adjusted under 35 U.S.C. 154(b) by 0 days.

(21) Appl. No.: 17/879,400

(22) Filed: Aug. 2, 2022

(65) Prior Publication Data

US 2023/0077981 A1 Mar. 16, 2023

(30) Foreign Application Priority Data

Sep. 15, 2021 (CN) ..... 202111082281.6

(51) Int. Cl.
*B68G 9/00* (2006.01)

(52) U.S. Cl.
CPC ..... *B68G 9/00* (2013.01)

(58) Field of Classification Search
CPC ..... B68G 9/00; B68G 15/00; B65G 35/00; B65G 47/05
See application file for complete search history.

(56) References Cited

U.S. PATENT DOCUMENTS 4,793,657 A * 12/1988 Mense ..... B25J 15/0616 414/797
5,792,309 A * 8/1998 Eto ..... B68G 9/00 198/418.5

(Continued)

FOREIGN PATENT DOCUMENTS

CN 102173373 A 9/2011
CN 203845810 U 9/2014

(Continued)

OTHER PUBLICATIONS

Notification of the First Office Action dated Feb. 22, 2022, issued in Chinese Application No. 202111082281.6; 15 pages (with English Translation).

(Continued)

*Primary Examiner* — Sarang Afzali
*Assistant Examiner* — Darrell C Ford
(74) *Attorney, Agent, or Firm* — Maier & Maier, PLLC

(57) ABSTRACT

A device and a method for manufacturing a pocket spring bed net. The device for manufacturing a pocket spring bed net includes a supply mechanism for providing sheet-like flexible materials; a spring string conveying mechanism with a first gap for clamping and conveying pocket spring strings; a glue spraying mechanism which sprays glue onto the sheet-like flexible materials and/or the pocket spring strings; and a pushing mechanism arranged in front of the spring string conveying mechanism and including at least one movable pushing and grasping component, where the pushing and grasping component pushes the sheet-like flexible materials and the pocket spring strings to be in contact with each other and bonded to form a pocket spring bed net. The embodiments improve the transportation cost and storage cost of pocket spring bed nets, and solve the problem (Continued)

that the pocket spring bed nets are difficult to compress and roll.

14 Claims, 7 Drawing Sheets

(56) References Cited

U.S. PATENT DOCUMENTS

| | | | | |
|---|---|---|---|---|
| 6,295,673 | B1 * | 10/2001 | Mossbeck | A47C 27/064 5/655.8 |
| 6,574,811 | B1 * | 6/2003 | Mossbeck | B68G 9/00 5/655.8 |
| 2003/0163977 | A1 * | 9/2003 | Huss | B68G 9/00 53/428 |
| 2011/0107572 | A1 * | 5/2011 | Kim | B21F 33/025 29/91.1 |
| 2016/0251161 | A1 * | 9/2016 | Tan | B65B 25/00 198/339.1 |
| 2019/0343289 | A1 * | 11/2019 | Long | A47C 21/046 |
| 2020/0198961 | A1 * | 6/2020 | Tan | A47C 27/064 |
| 2021/0309507 | A1 * | 10/2021 | Spinks | A47C 27/064 |

FOREIGN PATENT DOCUMENTS

| | | | | |
|---|---|---|---|---|
| CN | 104310088 | A | 1/2015 | |
| CN | 105480930 | A | 4/2016 | |
| CN | 206501131 | U | 9/2017 | |
| CN | 207470550 | U | 6/2018 | |
| CN | 108820945 | A | 11/2018 | |
| CN | 108887997 | A | 11/2018 | |
| CN | 110040289 | A | 7/2019 | |
| CN | 210547713 | U | 5/2020 | |
| CN | 112674545 | A | 4/2021 | |
| EP | 0985369 | A1 | 3/2000 | |
| TW | 250446 | B | 7/1995 | |
| WO | 2014207634 | A1 | 12/2014 | |
| WO | WO-2020042547 | A1 * | 3/2020 | A47C 27/063 |
| WO | WO-2020128498 | A1 * | 6/2020 | A47C 27/064 |

OTHER PUBLICATIONS

Search Report dated Dec. 27, 2022, in corresponding Polish Application No. P.442290, 13 pages.

* cited by examiner

DEVICE AND METHOD FOR MANUFACTURING POCKET SPRING BED NET

TECHNICAL FIELD

The application relates to the technical field of spring cushion manufacturing, in particular to a device for manufacturing a pocket spring bed net and a method for manufacturing the pocket spring bed.

BACKGROUND

An independent pocket spring bed net is used to make a high-grade mattress. Each independent pocket is formed by covering each independent spring which is pressed with folded non-woven fabric and then conducting welding. The independent pockets are connected, arranged, and then glued together to form a bed net. Generally, the bed net is covered with a sponge layer, so that the spring pockets can be stressed evenly, which makes it more comfortable to use. Each spring body works independently, plays a supporting role independently, and can expand and contract independently, so that when one of two people lying on a bed turns over or leaves, the other person will not be affected at all, thus ensuring a sound sleep.

During production of an independent pocket spring bed net, an existing production process of a spring core of a mattress is that individual springs are compressed and pocket by equipment, packaged and welded to form bagged spring strings, and then the pocket spring strings are arranged and glued into an integral spring core by a gluing machine.

A traditional independent pocket spring string has great flexibility in its length direction, and a manufactured spring mattress has a large stretch stroke or compression stroke, which leads to an unstable size. Therefore, during manufacturing, it is often necessary to add a steel wire frame or a sponge frame around a mattress to fix the size of the mattress. Because the added steel wire frame cannot be compressed or the sponge frame can hardly be compressed, the mattress cannot be rolled. In the case of a sponge frame, when the mattress is abandoned, sponge degradation and recycle will be a problem.

The content in the background art is only the technology known to the discloser, and does not represent the prior art in this field.

SUMMARY

The application aims to provide a device and a method for manufacturing a pocket spring bed net, which solve the problem that pocket spring mattresses are difficult to compress and roll, resulting in high transportation cost and storage cost of pocket spring bed nets.

According to an aspect of the application, a device for manufacturing a pocket spring bed net is provided, comprising a supply mechanism for providing sheet-like flexible materials; a spring string conveying mechanism having a first gap and used for clamping and conveying pocket spring strings; a glue spraying mechanism which sprays glue onto the sheet-like flexible materials and/or the pocket spring strings; and a pushing mechanism arranged in front of the spring string conveying mechanism and comprising at least one movable pushing and grasping component, wherein the pushing and grasping component pushes the sheet-like flexible materials and the pocket spring strings to be in contact with each other and bonded to form a pocket spring bed net.

According to some embodiments, the supply mechanism comprises a feeding component and a cutting component, the feeding component conveys roll-shaped flexible materials to the cutting component, and the cutting component cuts the flexible materials into the sheet-like flexible materials.

According to some embodiments, the supply mechanism comprises a turning plate component arranged above the pushing mechanism, the sheet-like flexible materials are attached to the turning plate component, and the sheet-like flexible materials are transferred to the pushing and grasping component by turning down the turning plate component.

According to some embodiments, the turning plate component and/or the pushing and grasping component are provided with suction holes for sucking the sheet-like flexible materials.

According to some embodiments, the turning plate component and/or the pushing and grasping component are provided with pressing claws, and the pressing claws fix the sheet-like flexible materials on the turning plate component and/or the pushing and grasping component.

According to some embodiments, the device for manufacturing a pocket spring bed net further comprises a bed net combination mechanism which comprises an upper pressing plate and a lower platform, wherein a second gap between the upper pressing plate and the lower platform is configured to clamp the pocket spring bed net, and the pushing mechanism pushes the sheet-like flexible materials together with the pocket spring strings compressed by the spring string conveying mechanism to the bed net combination mechanism, so as to form the pocket spring bed net through contact and bonding with each other; and the glue spraying mechanism comprises at least two spray nozzles, at least one of the spray nozzles is arranged between the spring string conveying mechanism and the pushing mechanism, and at least one of the spray nozzles is arranged between the bed net combination mechanism and the spring string conveying mechanism.

According to some embodiments, the upper pressing plate comprises a first conveyor belt, and the lower platform comprises a second conveyor belt.

According to some embodiments, at least one of the spray nozzles is arranged at one side of the spring string conveying mechanism close to the pushing mechanism, and when the spring strings conveyed by the spring string conveying mechanism pass through the spray nozzle, glue is sprayed to one side of the spring strings; and at least one of the spray nozzles is arranged at one side of the spring string conveying mechanism close to the bed net combination mechanism, and when the spring strings conveyed by the spring string conveying mechanism pass through the spray nozzle, glue is sprayed to the other side of the spring strings.

According to some embodiments, at least one of the spray nozzles is arranged at one side of the spring string conveying mechanism close to the pushing mechanism, and when the spring strings are input by the spring string conveying mechanism, glue is sprayed to one side of the spring strings; and at least one of the spray nozzles is arranged between the bed net combination mechanism and the spring string conveying mechanism, moves reciprocally in a spring string conveying direction, and sprays glue to a side of the bed net clamped by the bed net combination mechanism.

According to some embodiments, the feeding component comprises at least two first rotating shafts, wherein at least one of the first rotating shafts outputs power, the roll-shaped flexible materials are placed on two first rotating shafts, the roll-shaped flexible materials make contact with surfaces of the at least two first rotating shafts, and the first rotating shafts rotate to drive the roll-shaped flexible materials to rotate and release the flexible materials; and at least two second rotating shafts, wherein at least one of the second rotating shafts outputs power, and two second rotating shafts are used for clamping and conveying the released flexible materials.

The first rotating shaft with power and the second rotating shaft with power are driven by a same motor, and have a same linear speed of surface rotation.

According to some embodiments, the turning plate component comprises at least one pair of suction plates capable of moving relatively, and the suction plates are provided with suction holes.

Each suction plate is provided with a sponge layer or a soft rubber layer on a working surface sucking the sheet-like flexible materials to increase sucking friction of the working surface.

According to some embodiments, the turning plate component and/or the pushing and grasping component are connected with a vacuum component through a pipeline, and the vacuum component provides suction for the turning plate component and/or the pushing and grasping component.

According to some embodiments, the cutting component comprises: a clamping groove used for compressing the flexible materials;

a cutter rotating at a high speed electronically or pneumatically; and a guide rail, the cutter being movably arranged on the guide rail and being able to move along the guide rail in the clamping groove to cut the roll-shaped flexible materials into the sheet-like flexible materials after the roll-shaped flexible materials are released.

According to an aspect of the application, a method for manufacturing a pocket spring bed net is provided, comprising:

S1, cutting roll-shaped flexible materials into sheet-like flexible materials, spreading and sucking the sheet-like flexible materials onto a pushing and grasping component;

S2, providing pocket spring strings, tightly pressing every two pocket springs in the pocket spring strings against each other, and spraying glue onto one side of the pocket spring string opposite to the sheet-like flexible materials;

S3, spraying glue onto another side of the pocket spring string or onto a side of a pocket spring bed net opposite to the pocket spring strings;

S4, pushing the sheet-like flexible materials on the pushing and grasping component to be in contact with each other and bonded with the pocket spring strings;

S5, continuing to push, by the pushing and grasping component, the pocket spring strings bonded with the sheet-like flexible materials to a next station, so that the pocket spring strings are bonded with sheet-like flexible materials on one side of the pocket spring bed net; and S6, repeating steps S1-S5 to finally form the pocket spring bed net.

According to some embodiments, one side of the pocket spring bed net is provided with the pocket spring strings or the sheet flexible materials.

By using the above device and method for manufacturing a pocket spring bed net, the storage and transportation costs of spring mattresses are reduced, and the comfort and durability of the spring mattresses are improved. According to the pocket spring bed net manufactured by the device and method for manufacturing a pocket spring bed net provided by the invention, the pocket springs are in close contact with each other, and the sheet-like flexible materials are bonded between the pocket springs in a stretched state, so that excessive stretching stroke or squeezing stroke of the pocket spring strings in the length direction can be avoided through the sheet-like flexible materials, thereby realizing the dimensional stability of the pocket spring bed net. Besides, the pocket spring bed net is formed by tightly bonding the pocket spring strings with each other through the sheet-like flexible materials, so the pocket spring bed net can be compressed and rolled. Therefore, the pocket spring bed net manufactured by the device and the method for manufacturing a pocket spring bed net can be compressed and rolled, thus effectively reducing transportation and storage costs, and facilitating manual handling.

For a better understanding of the features and technical content of the application, please refer to the following detailed description and drawings of the application, but the description and drawings are only used to illustrate the application, but do not limit the scope of protection of the application in any way.

BRIEF DESCRIPTION OF THE DRAWINGS

The implementations of the invention will be described in detail with reference to the accompanying drawings. Here, the drawings that form a part of the disclosure are used to provide a further understanding of the disclosure. The illustrative embodiments of the disclosure and their description are used to explain the disclosure, and do not constitute an improper limitation of the disclosure. In the drawings.

DETAILED DESCRIPTION OF THE EMBODIMENTS

Figure 1:
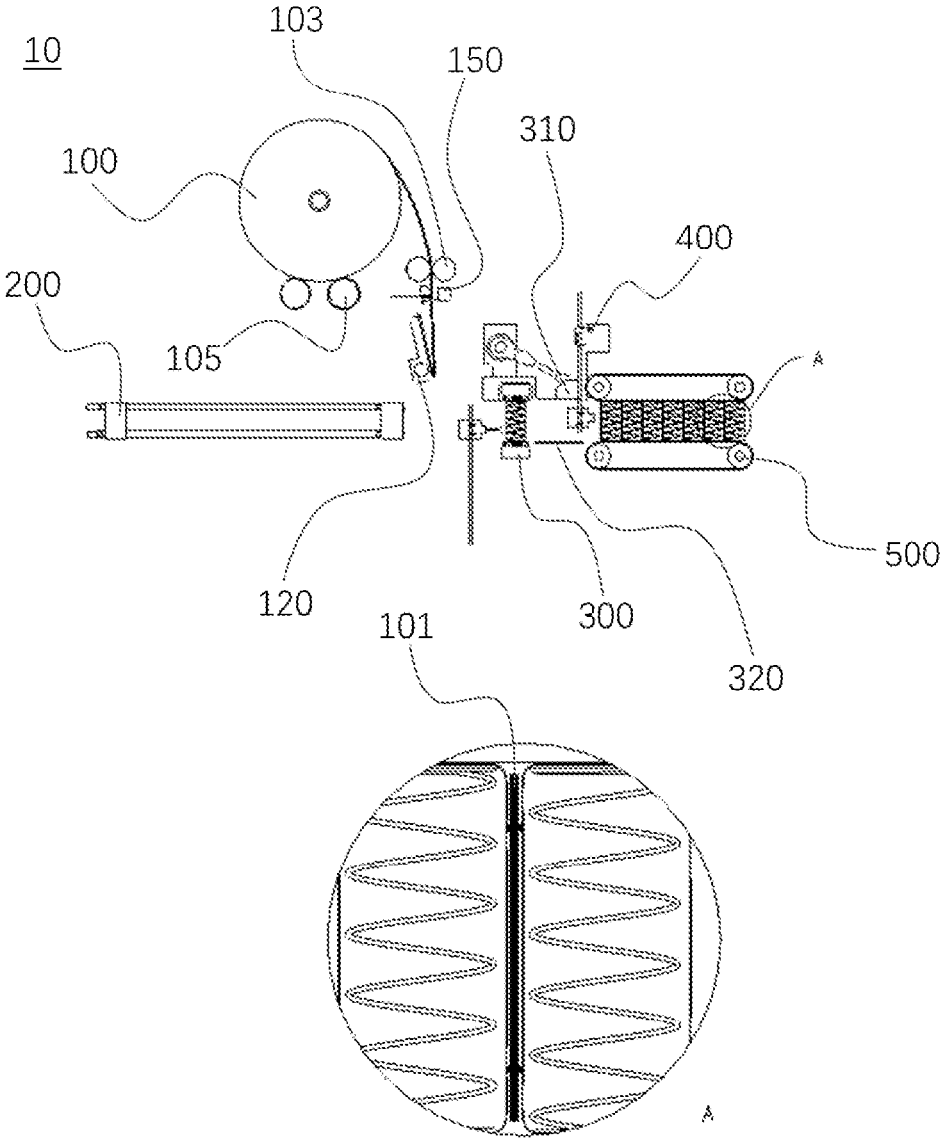
FIG. 1 shows a structural diagram of a device for manufacturing a pocket spring bed net according to an exemplary embodiment of the application.

Only some exemplary embodiments are briefly described below. As those skilled in the art can realize, the described embodiments can be modified in various different ways without departing from the spirit or scope of the application. Therefore, the drawings and description should be regarded as illustrative rather than restrictive in nature.

In the description of the application, it should be understood that directional or positional relationships indicated by the terms such as "center", "longitudinal", "transverse", "length", "width", "thickness", "upper", "lower", "front", "rear", "left", "right", "vertical", "horizontal", "top", "bottom", "inner", "outer", "clockwise" and "counterclockwise" are based on the directional or positional relationships shown in the drawings, which are only for the convenience of describing the application and simplifying the description, but do not indicate or imply that the referred devices or elements must have a specific orientation or be constructed and operated in a specific orientation, so they cannot be understood as limiting the application. In addition, the terms "first" and "second" are only used for the descriptive purpose, and cannot be understood as indicating or implying relative importance or implicitly indicating the number of indicated technical features. Therefore, the features defined with "first" and "second" may be explicitly or implicitly include one or more of the features. In the description of the application, "a plurality of" means two or more, unless otherwise specifically defined.

In the description of the application, it should be noted that the terms "install", "communicate" and "connect" should be understood in a broad sense unless otherwise specified and defined. For example, it can be fixed connection, detachable connection or integrated connection; it can be mechanical connection or electric connection or communication; and it can be direct connection, indirect connection through intermediate media or internal communication of two elements or interaction of two elements. For those of ordinary skill in the art, the specific meaning of the above terms in the application can be understood in specific situations.

In this application, unless otherwise explicitly specified and limited, the first feature being "above" or "below" the second feature may include that the first and second features are in direct contact with each other, or may also include that the first and second features are not in direct contact with each other but are in contact with each other through other features in between. Further, the first feature being "above", "on" or "upper than" the second feature includes that the first feature is directly or obliquely above, on or upper than the second feature, or simply indicates that the first feature is higher in horizontal height than the second feature. The first feature being "below", "under" or "lower than" the second feature includes that the first feature is directly or obliquely below, under or lower than the second feature, or simply indicates that the first feature is lower in horizontal height than the second feature.

The following provides many different embodiments or examples for implementing different structures of the application. In order to simplify the application, components and arrangements of specific examples are described below. Of course, they are only examples and are not intended to limit the application. In addition, the application may repeat reference numerals and/or reference letters in different examples, and such repetition is for the sake of simplicity and clarity, and does not itself indicate the relationship between the various embodiments and/or arrangements discussed. In addition, the application provides examples of various specific processes and materials, but those of ordinary skill in the art may realize the application of other processes and/or the use of other materials.

Because a pocket spring bed net is large and has high transportation and storage costs, it is necessary to compress and roll the pocket spring bed net, which can effectively reduce the transportation and storage costs. Therefore, this application proposes a device and a method for manufacturing a pocket spring bed net to fix the size of the pocket spring bed net, and can realize the compression and rolling of the pocket spring bed net.

The preferred embodiments of the application will be described hereinafter with reference to the accompanying drawings. It should be understood that the preferred embodiments described here are only used to illustrate and explain the application, and are not used to limit the application.

Figure 2:
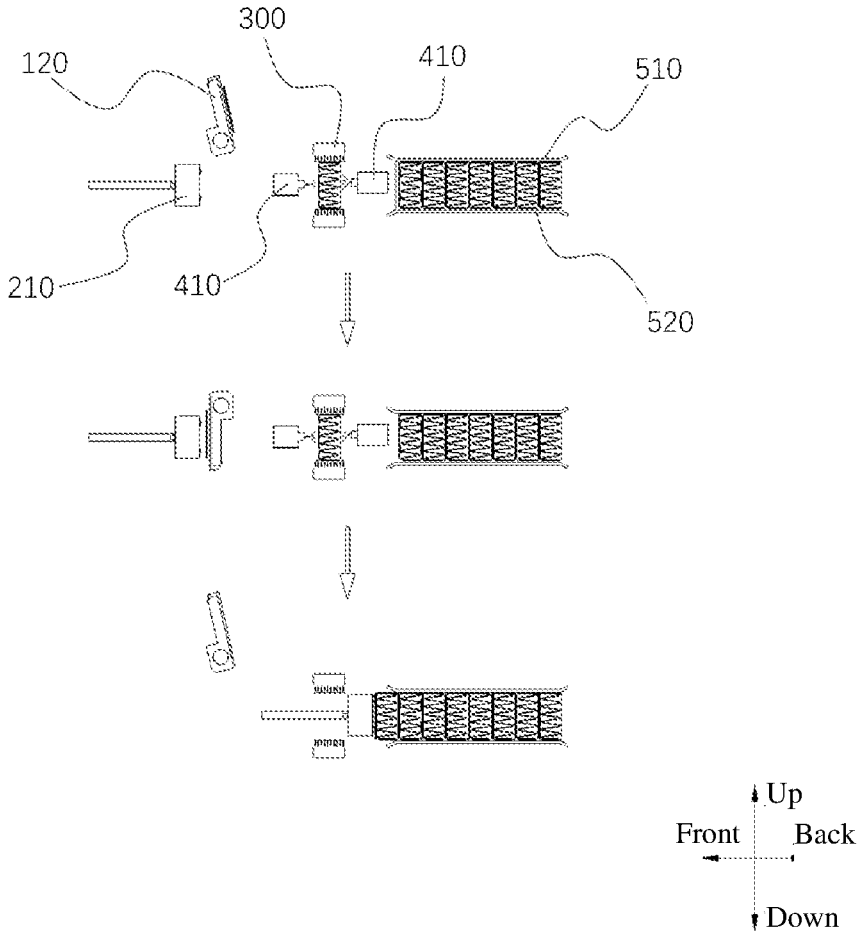
FIG. 2 shows a schematic diagram of a workflow of a device for manufacturing a pocket spring bed net according to an exemplary embodiment of the application.

FIG. 1 shows a structural diagram of a device for manufacturing a pocket spring bed net according to an exemplary embodiment of the application. FIG. 2 shows a schematic diagram of a workflow of a device for manufacturing a pocket spring bed net according to an exemplary embodiment of the application.

As shown in FIGS. 1-2, according to an exemplary embodiment of the application, a device for manufacturing a pocket spring bed net 10 of the present application comprises a supply mechanism 100, a spring string conveying mechanism 300, a glue spraying mechanism 400 and a pushing mechanism 200.

Referring to FIG. 2, the supply mechanism 100 provides sheet-like flexible materials, and the turning plate component absorbs or clamps the sheet-like flexible materials and then rotates them. After rotating for a certain angle, the sheet-like flexible materials make contact with the pushing mechanism to be transferred, then the sheet-like flexible materials are pushed to adhere to the pocket spring strings sprayed with glue, and the sheet-like flexible materials are continued to be pushed to make contact with and adhere to the pocket spring strings to form a pocket spring bed net.

Referring to FIG. 1, the supply mechanism 100 provides the sheet-like flexible materials 101, the spring string conveying mechanism 300 has a first gap for clamping and conveying the pocket spring strings 301, and the glue spraying mechanism 400 sprays glue onto the sheet-like flexible materials 101 and/or the pocket spring strings 301. And the pushing mechanism 200 is arranged in front of the spring string conveying mechanism 300 and comprises at least one movable pushing and grasping component 210, and the pushing and grasping component 210 pushes the sheet-like flexible materials 101 and the pocket spring strings 301 to be in contact with each other and bonded to form a pocket spring bed net 600.

The number of the pushing and grasping components 210 of the pushing mechanism 200 can be one or more. In the embodiment of the application, one or two pushing and grasping components 210 are adopted, and the pushing and grasping components 210 are horizontally placed to jointly push the sheet-like flexible materials 101 and the spring strings to move to be combined into the bed net 600. The sheet-like flexible materials 101 are bonded between the pocket spring strings 301, and the sheet-like flexible materials 101 are mainly used to control the stretching or squeezing size of the pocket spring strings in the length direction, so as to avoid the size change of a single spring string.

Figure 3:
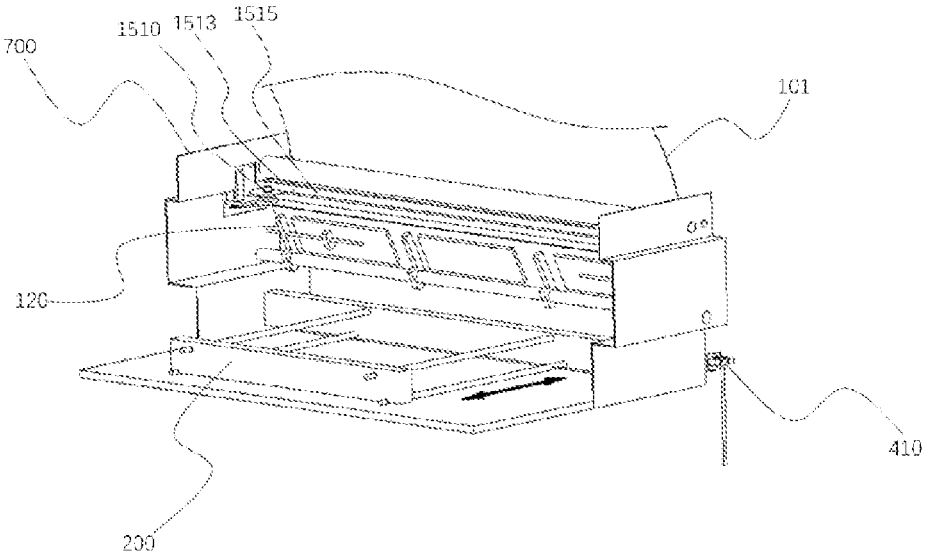
FIG. 3 shows a perspective view of a device for manufacturing a pocket spring bed net according to an exemplary embodiment of the application.

FIG. 3 shows a perspective view of a device for manufacturing a pocket spring bed net according to an exemplary embodiment of the application.

As shown in FIGS. 1 and 3, according to the embodiment of the application, the supply mechanism 100 comprises a feeding component and a cutting component 150. The feeding component conveys roll-shaped flexible materials to the cutting component 150, and the cutting component 150 cuts the flexible materials into the sheet-like flexible materials 101.

According to the embodiment of the application, the feeding component comprises at least two first rotating shafts 105 and at least two second rotating shafts 103.

At least one of the first rotating shafts 105 outputs power, the roll-shaped flexible materials are placed on two first rotating shafts 105, the roll-shaped flexible materials make contact with surfaces of at least two first rotating shafts 105, and the first rotating shafts 105 rotate to drive the roll-shaped flexible materials to rotate and release the flexible materials.

At least one of the second rotating shafts 103 outputs power, and two second rotating shafts 103 are used for clamping and conveying the released flexible materials.

The first rotating shaft 105 with power and the second rotating shaft 103 with power are driven by the same motor, and have a same linear speed of surface rotation.

The feeding component also comprises stoppers, and a material roll will move downward in the process of decreasing gradually. In order to prevent the material roll from swinging when moving, the stoppers are arranged at two ends of the material roll, the roll-shaped flexible materials are placed in the stoppers, and the roll-shaped flexible materials can move under the action of the stoppers.

The feeding mechanism conveys the roll-shaped flexible materials to the cutting component 150 to be cut into identical sheet-like flexible materials 101. The roll-shaped flexible materials can be cloth, plastic, sponge, soft rubber sheets, etc. When being turned over and pushed, the sheet-like flexible materials 101 make contact with and adhere to the sides of the pocket spring strings 301, and are continued to be pushed towards a bed net combination mechanism 500, so that the pocket spring strings 301 sprayed with glue and bonded with the sheet-like flexible materials 101 are mutually bonded to form the pocket spring bed net 600, which is conveyed under the action of the bed net combination mechanism 500.

According to the embodiment of the application, the cutting component 150 comprises a clamping groove 1513, a cutter 1510, two positioning blocks 1515 and a guide rail.

The clamping groove 1513 is used for compressing the flexible materials. The cutter 1510 rotates at a high speed electronically or pneumatically. The cutter 1510 is movably arranged on the guide rail and able to move along the guide rail in the clamping groove 1513 to cut flexible materials obtained after releasing the roll-shaped flexible materials into the sheet-like flexible materials 101.

The clamping groove 1513 serves as a groove allowing the cutter 1510 to move therein, which facilitates cutting. In addition, if the turning plate component 120 can be turned up to fix the sheet-like flexible materials 101, the turning plate component can replace the two positioning blocks 1515 to clamp the sheet-like flexible materials 101, and the clamping groove 1513 cooperates with the turning plate component 120 to clamp the flexible materials released by the roll.

The cutting component 150 can be cut by a rotary blade, a non-rotary blade or a hot melt process, and the cutting method is not specifically limited in this application.

A gap exists between the two positioning blocks 1515 and the clamping groove 1513, which can be selectively moved to adjust the gap. Specifically, a slide rail can be installed on a frame 700, and the two positioning blocks 1515 can move on the slide rail. During cutting, the two positioning blocks 1515 move towards the clamping groove 1513 to adjust the gap and clamp the roll-shaped flexible materials. A cutting machine is installed on the positioning block, the cutting machine drives the rotary blade to rotate through a motor, and the positioning block is provided with a receding groove allowing the rotary blade to move therein. The rotary blade moves in the receding groove to cut the roll-shaped flexible materials into the sheet-like flexible materials 101.

Optionally, at least one anti-slip strip is installed on at least one positioning block, the anti-slip strip is installed away from the receding groove, and the anti-slip strip is installed on a clamping surface.

According to the embodiment of the application, the supply mechanism 100 comprises a turning plate component 120, the turning plate component 120 is arranged above the pushing mechanism 200, and the sheet-like flexible materials 101 are attached to the turning plate component 120. The sheet-like flexible materials 101 are transferred to the pushing and grasping component 210 by turning down the turning plate component 120.

Figure 4:
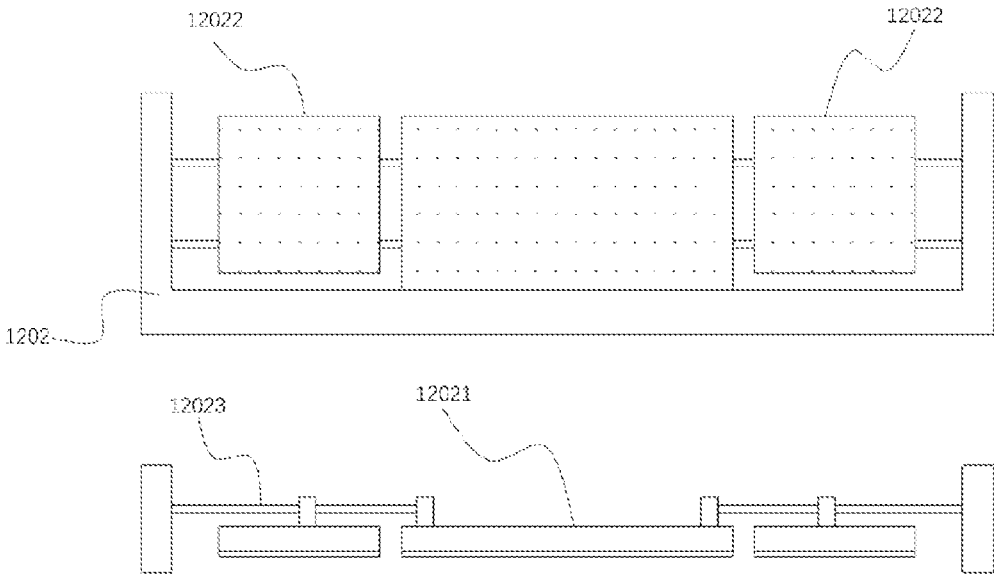
FIG. 4 and FIG. 5 are schematic diagrams of a suction plate structure of a turning plate component and a pushing and grasping component of a device for manufacturing a pocket spring bed net according to an exemplary embodiment of the application.
Figure 5:
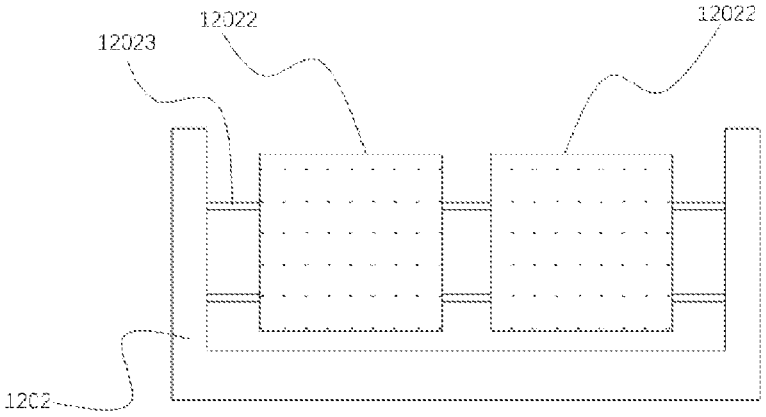

FIGS. 4-5 are schematic diagrams of a suction plate structure of a turning plate component and a pushing and grasping component of a device for manufacturing a pocket spring bed net according to an exemplary embodiment of the application.

As shown in FIGS. 4-5, any one of the turning plate component 120 and the pushing and grasping component 210 can be provided with a suction plate, and a suction hole of the suction plate is evacuated to form negative pressure, so as to adsorb the sheet-like flexible materials 101. The turning plate component 120 comprises at least one pair of suction plates 1202 that can move relatively, and the suction plates 1202 have suction holes.

Specifically, at least two suction plates 1202 are provided, and the suction plates at two ends can move. After the sheet-like flexible materials are adsorbed on the suction plates, the suction plates at the two ends move reversely to flatten the sheet-like flexible materials.

According to the embodiment of the application, the suction plate 1202 comprises a sliding rod 12023, a first suction cup 12021 and two second suction cups 12022.

The first suction cup 12021 is fixedly arranged on the suction plate 1202, and the two second suction cups 12022 are arranged on the sliding rod 12023, are respectively arranged on two sides of the first suction cup 12021, and can slide on the sliding rod 12023 in opposite directions.

According to another embodiment of the application, the suction plate 1202 comprises a sliding rod 12023 and two second suction cups 12022. The two second suction cups 12022 are arranged on the sliding rod 12023 and can slide in opposite directions.

Each suction plate 1202 is provided with a sponge layer or a soft rubber layer on a working surface sucking the sheet-like flexible materials 101 to increase sucking friction of the working surface, thus improving the adsorption effect of the working surface. When the device for manufacturing a pocket spring bed net 10 is in operation, after the suction plate 1202 adsorbs the sheet-like flexible materials 101, the two second suction cups 12022 move in opposite directions, so that the sheet-like flexible materials 101 are stretched to two sides and straightened, thus achieving the purpose of flattening the flexible materials.

The turning plate component 120 and/or the pushing and grasping component 210 are connected with a vacuum component through a pipeline, and the vacuum component provides suction for the turning plate component 120 and/or the pushing and grasping component 210.

The turning plate component 120 and/or the pushing component 210 are provided with suction holes for sucking the sheet-like flexible materials 101.

The suction holes in the suction plate 1202 communicate with a vacuum generator of a vacuum component, and the vacuum generator generates high-pressure air circulation, so that the suction holes form negative pressure and adsorb the sheet-like flexible materials 101. One vacuum generator can be connected with several suction holes, and one turning plate component 120 or pushing and grasping component 210 is provided with several vacuum generators.

In another embodiment, the suction plate 1202 can be a suction cup or a suction hole connected by a pipeline. The suction hole can reduce a contact gap between the sheet-like flexible materials 101 and the suction plate 1202 when sucking the sheet-like flexible materials 101, so that the sheet-like flexible materials 101 are flatter and the adsorption effect is better. The suction plates 1202 all have an adsorption function, and their structures are interchangeable, as long as identical functions can be realized.

Figure 6:
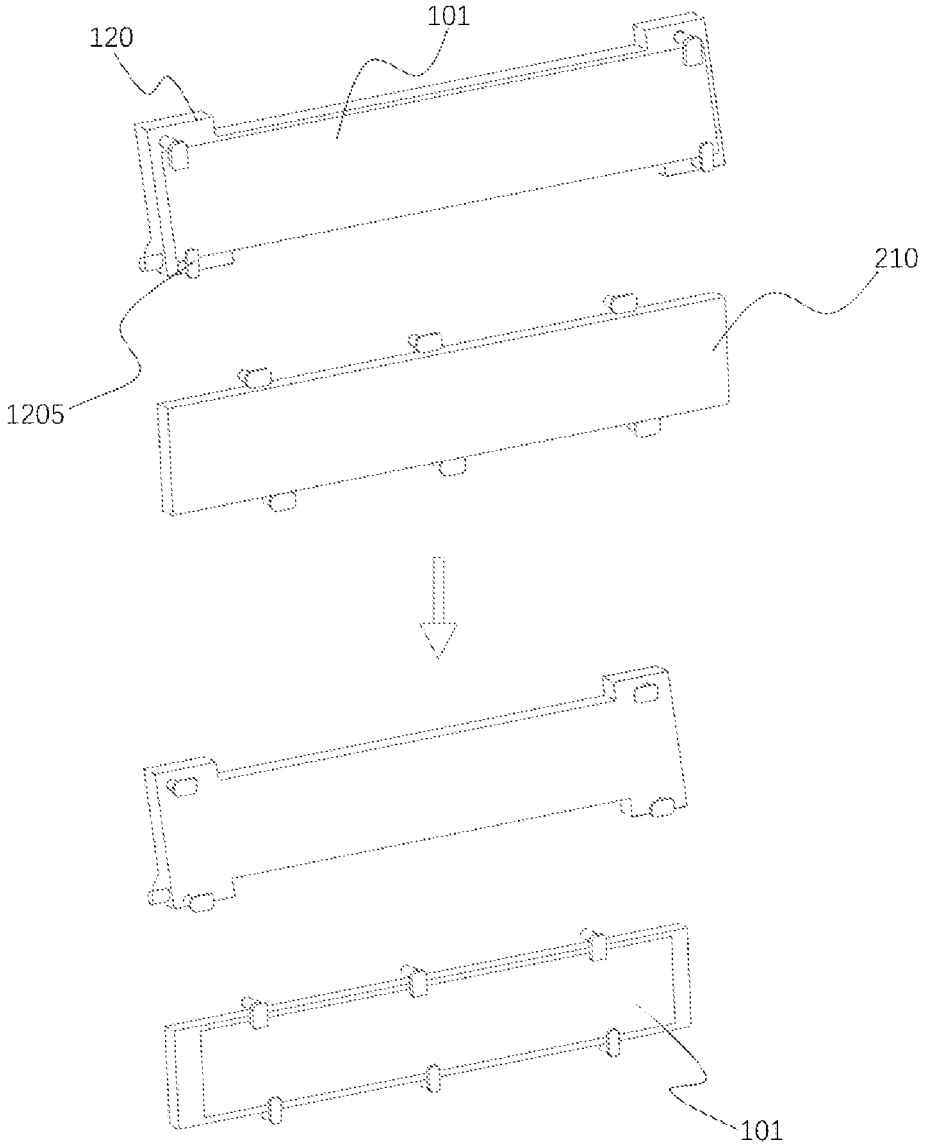
FIG. 6 shows a schematic diagram of a pressing claw of a turning plate component and a pushing and grasping component of a device for manufacturing a pocket spring bed net according to an exemplary embodiment of the application.

FIG. 6 shows a schematic diagram of a pressing claw of a turning plate component and a pushing and grasping component of a device for manufacturing a pocket spring bed net according to an exemplary embodiment of the application.

As shown in FIG. 6, the turning plate component 120 and/or the pushing and grasping component 210 are provided with pressing claws 1205, and the pressing claws 1205 fix the sheet-like flexible materials 101 on the turning plate component 120 and/or the pushing and grasping component 210.

The pressing claw 1205 is connected to a turning cylinder, and the sheet-like flexible materials 101 are fixed on the suction plate of the turning plate component 120 and/or the pushing and grasping component 210 by rotating and stretching the pressing claws 1205 by the turning cylinder.

The pressing claws and the suction plates can be combined in any way for the turning plate component 120 and the pushing and grasping component 210.

Figure 7:
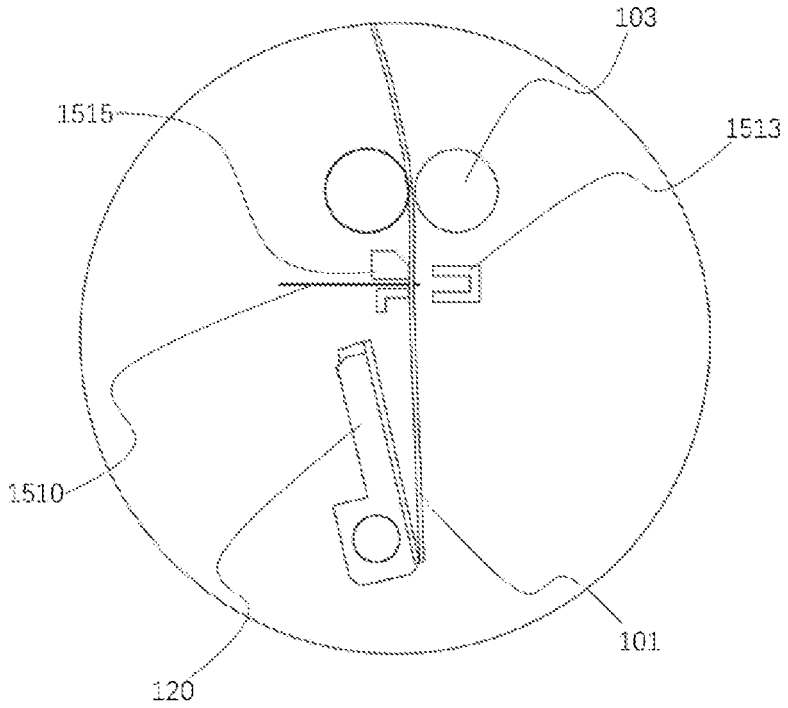
FIG. 7 and FIG. 8 are structural diagrams of a turning plate component of a device for manufacturing a pocket spring bed net according to an exemplary embodiment of the application.
Figure 8:
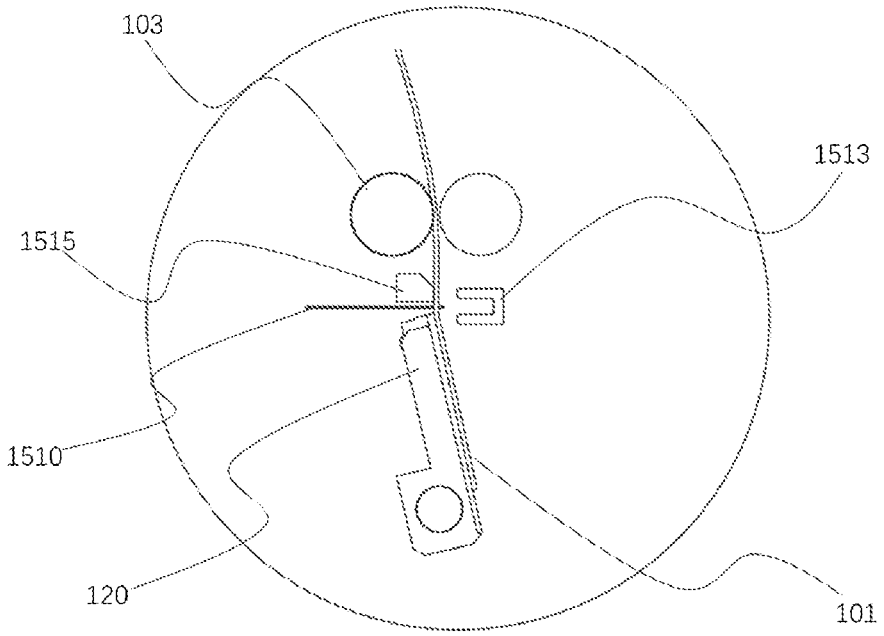

FIGS. 7-8 are structural diagrams of a turning plate component of a device for manufacturing a pocket spring bed net according to an exemplary embodiment of the application.

Referring to the turning component in FIG. 1 and the two implementations in FIGS. 7-8, it can be seen that the roll-shaped flexible materials naturally droop under the action of gravity when being cut, the drooping flexible materials pass through the gap between the clamping groove 1513 and two positioning blocks 1515 and make contact with the turning plate component 120, and the two positioning blocks 1515 move towards the clamping groove 1513 to clamp the drooping flexible materials. The suction plate 1202 installed on the turning plate component 120 adsorbs the flexible materials on the turning plate component 120. The cutter 1510 moves in a positioning groove between the two positioning blocks 1515 to cut the cloth. The two positioning blocks 1515 are away from the clamping groove 1513 to loosen the cut drooping flexible materials (i.e., the sheet-like flexible materials 101). The two second suction cups 12022 can move on the sliding rod 12023 under the action of transmission parts (cylinders, screw rods and cranks). The flexible materials are stretched flat, and two rotary clamping cylinders are installed on a mounting plate of the pushing mechanism 200. When the sheet-like flexible materials 101 are adsorbed on the turning plate component 120, the two rotary clamping cylinders clamp and push the sheet-like flexible materials 101 after the sheet-like flexible materials make contact with the mounting plate.

The turning plate component 120 rotates to transfer the sheet-like flexible materials 101 to the pushing and grasping component 210, and the pushing and grasping component 210 adsorbs the sheet-like flexible materials 101 and moves to the spring string conveying mechanism 300, so that the spring strings and the sheet-like flexible materials 101 are bonded to form the bed net.

Figure 9:
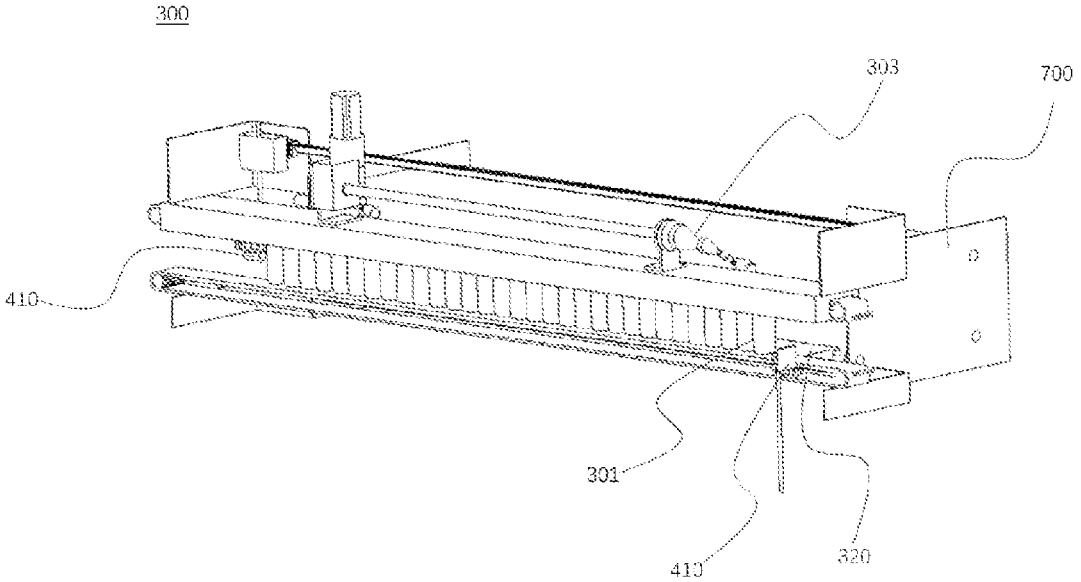
FIG. 9 is a perspective view of a spring string conveying mechanism of a device for manufacturing a pocket spring bed net according to an exemplary embodiment of the application.

FIG. 9 is a perspective view of a spring string conveying mechanism of a device for manufacturing a pocket spring bed net according to an exemplary embodiment of the application.

As can be seen from FIG. 9, the spring string conveying mechanism 300 comprises two conveyor belts with a gap in between. The conveyor belts clamp two ends of the pocket spring strings 301 for conveying, and the conveyor belts are provided with transition wheels, which can also be replaced with plate-like structural members. When the conveyance of the pocket spring strings 301 starts, at least one spray nozzle 410 located at an inlet sprays glue on the surfaces of the pocket spring strings 301, and the pocket spring strings 301 stop moving when arriving at an expected position. At this point, the pushing mechanism 200 adsorbs the sheet-like flexible materials 101 which are tightly boned with the surfaces of the pocket spring strings 301 and then continued to be pushed into the bed net combination mechanism 500.

Figure 10:
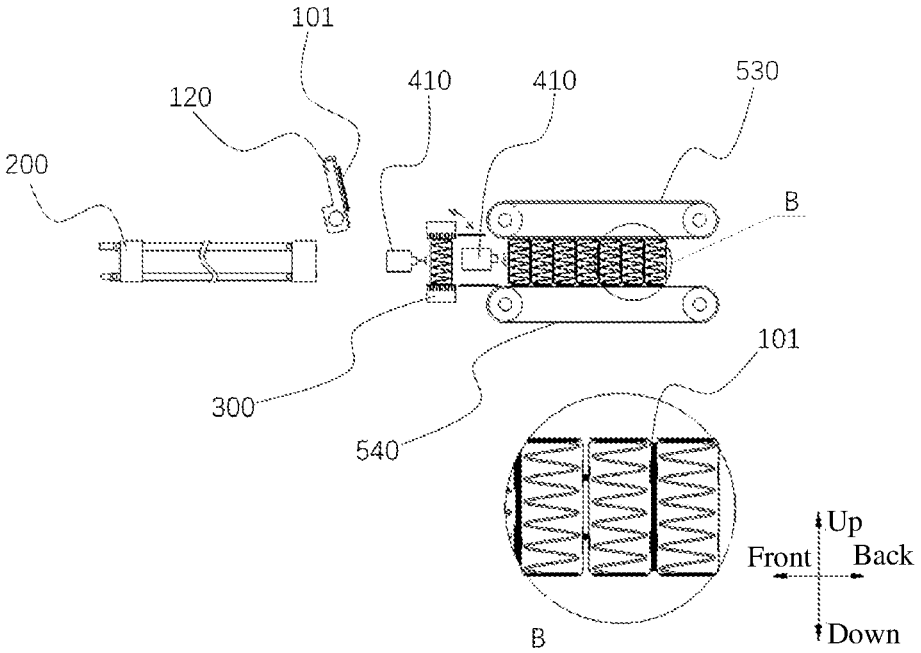
FIG. 10, FIG. 11 and FIG. 12 are structural diagrams of a glue spraying mechanism of a device for manufacturing a pocket spring bed net according to an exemplary embodiment of the application.
Figure 11:
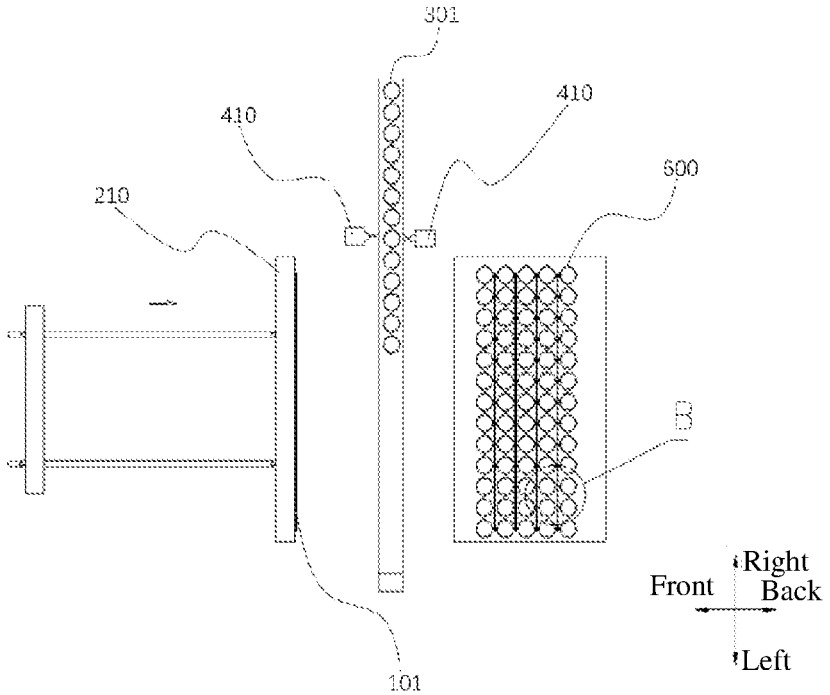
Figure 12:
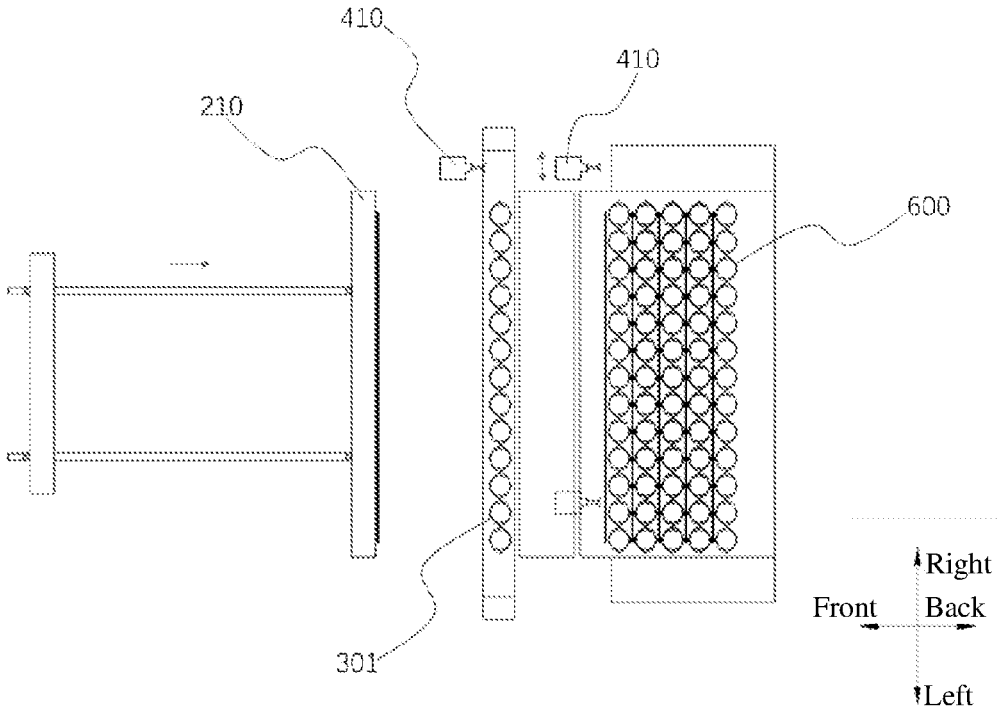

FIGS. 10-12 are structural diagrams of a glue spraying mechanism of a device for manufacturing a pocket spring bed net according to an exemplary embodiment of the application.

As shown in FIGS. 10-12, the device for manufacturing a pocket spring bed net 10 further comprises the bed net combination mechanism 500, which comprises an upper pressing plate 510 and a lower platform 520, a second gap between the upper pressing plate 510 and the lower platform 520 is configured to clamp the pocket spring bed net 600, and the pushing mechanism 200 pushes the sheet-like flexible materials 101 and the pocket spring strings 301 compressed by the spring string conveying mechanism 300 to the bed net combination mechanism 500 together, so as to form the pocket spring bed net 600 through contact and bonding contact and bonding.

The glue spraying mechanism 400 comprises at least two spray nozzles, at least one spray nozzle 410 is arranged between the spring string conveying mechanism 300 and the pushing mechanism 200, and at least one spray nozzle 410 is arranged between the bed net combination mechanism 500 and the spring string conveying mechanism 300.

The bed net combination mechanism 500 may comprise two clamping plates or a conveyor belt. In this application, it is preferred that the upper pressing plate 510 comprises a first conveyor belt 530, and the lower platform 520 comprises a second conveyor belt 540.

The bed net combination mechanism 500 transports the spring strings to a second gap between the conveyor belts, and the spring strings are arranged and sprayed with glue to be bonded. The pushing and grasping component 210 fixes (clamps or adsorbs) the sheet-like flexible materials 101 and pushes the sheet-like flexible materials to be in contact with each other and bonded with the spring strings sprayed with glue, and the spring strings are continued to be pushed to be bonded with the bed net 600 as a whole. The sheet-like flexible materials are bonded and fixed between two adjacent spring strings, and when the spring strings are subjected to vertical pressure, the sheet-like flexible materials 101 can fix the size of the spring strings. One pocket spring string 301 can be arranged between the sheet-like flexible materials 101, and the sheet-like flexible materials 101 are bonded with the pocket spring strings 301, or a plurality of pocket spring strings 301 can be arranged, the sheet-like flexible materials 101 are bonded with the pocket spring strings 301, and the pocket spring strings 301 are bonded with each other.

According to one layout structure of spray nozzles, one spray nozzle 410 is arranged at one side of the spring string conveying mechanism 300 close to the pushing mechanism 200, and when the spring strings conveyed by the spring string conveying mechanism 300 pass through the spray nozzle, glue is sprayed to one side of the spring strings. And one spray nozzle 410 is arranged at one side of the spring string conveying mechanism 300 close to the bed net combination mechanism 500, and when the spring strings conveyed by the spring string conveying mechanism 300 pass through the spray nozzle, glue is sprayed to the other side of the spring strings.

According to another layout structure of spray nozzles, one spray nozzle 410 is arranged at one side of the spring string conveying mechanism 300 close to the pushing mechanism 200, and when the spring strings are input by the spring string conveying mechanism 300, glue is sprayed to one side of the spring strings; and one spray nozzle 410 is arranged between the bed net combination mechanism 500 and the spring string conveying mechanism 300, moves reciprocally in a spring string conveying direction, and sprays glue to a side of the bed net 600 clamped by the bed net combination mechanism 500.

One or more spray nozzles can be arranged side by side on the same side, and the number of spray nozzles can be determined according to the demand of glue spraying, but at least one nozzle is required.

The spring string conveying mechanism 300 also comprises a first transition plate 310 and a second transition plate 320. The upper first transition plate 310 can be opened optionally through rotation, lifting or translation. A cross beam is installed on the frame 700, and two crank transmission components 303 are installed on the cross beam. A motor drives the crank transmission component 303 to rotate, and an output end of the crank transmission component 303 is connected to the first transition plate 310, one end of the first transition plate 310 is hinged with the cross beam, and the first transition plate 310 can be opened by rotating around a hinge joint.

A gap is formed between the first transition plate 310 and the second transition plate 320. The upper first transition plate 310 can be adjusted up and down, but the gap between the first transition plate 310 and the second transition plate 320 after adjustment must be flush with a lower surface of a gap between the upper pressing plate 510 and the lower platform 520.

The bed net combination mechanism 500 is integrally provided with at least one spray nozzle 410. When the at least one spray nozzle 410 reciprocates in a gap between the first conveyor belt 530 and the second conveyor belt 540 to spray glue, the upper first transition plate 310 must be opened, so that the at least one spray nozzle 410 has a displacement space, and the at least one spray nozzle 410 moves on the slide rail to spray glue. After glue spraying, the first transition plate 310 is closed, and the pushing mechanism 200 pushes the pocket spring strings 301 and the sheet-like flexible materials 101 bonded together to move, so that the pocket spring strings 301 are bonded with the pocket spring bed net 600 in the bed net combination mechanism 500.

The first conveyor belt 530 rotates to convey a bed core by the width of one pocket spring string 301, leaving a space for the next pocket spring string 301 to be bonded and placed. Optionally, the at least one spray nozzle 410 can move up and down for adjustment.

The at least one spray nozzle 410 is connected with an air cylinder or a lead screw to move up and down, and moves linearly or curvilinearly on one side of the spring string, and the so-called curvilinear motion refers to a wave linear motion on a vertical surface.

According to an exemplary embodiment of the application, a method for manufacturing a pocket spring bed net is provided, which comprises the following steps:

S1, cutting roll-shaped flexible materials into sheet-like flexible materials 101, spreading and sucking the sheet-like flexible materials 101 onto a pushing and grasping component 210;

S2, providing pocket spring strings 301, tightly pressing every two pocket springs in the pocket spring strings 301 against each other, and spraying glue onto one side of the pocket spring string 301 opposite to the sheet-like flexible materials;

S3, spraying glue onto another side of the pocket spring string 301 or onto a side of a pocket spring bed net 600 opposite to the pocket spring strings 301;

S4, pushing the sheet-like flexible materials 101 on the pushing and grasping component 210 to be in contact with each other and bonded with the pocket spring strings 301;

S5, continuing to push, by the pushing and grasping component 210, the pocket spring strings 301 bonded with the sheet-like flexible materials 101 to a next station, so that the pocket spring strings 301 are bonded with sheet-like flexible materials 101 on one side of the pocket spring bed net 600; and S6, repeating S1-S5 to finally form the pocket spring bed net 600.

According to the embodiment of the application, one side of the pocket spring bed net 600 is provided with the pocket spring strings 301 or the sheet flexible materials 101.

At last, it should be noted that the above embodiments are only exemplary embodiments of the disclosure, and are not intended to limit the disclosure. Although the disclosure has been described in detail with reference to the aforementioned embodiments, it is still possible for those skilled in the art to modify the technical schemes described in the aforementioned embodiments or equivalently replace some of the technical features. Any modification, equivalent substitution, improvement, etc. made within the spirit and principle of this disclosure should be included in the scope of protection of this disclosure.

What is claimed is:

1. A device for manufacturing a pocket spring bed net, comprising:

a supplier, for providing sheet-like flexible materials;

a spring string conveyer, having a first gap and for clamping and conveying pocket spring strings;

a glue sprayer, for spraying glue onto the sheet-like flexible materials and/or the pocket spring strings; and a pusher, arranged in front of the spring string conveyer and comprising at least one movable pushing and grasping component, wherein the pushing and grasping component pushes the sheet-like flexible materials and the pocket spring strings to be in contact with each other and bonded to form a pocket spring bed net;

wherein the supplier comprises a feeding component and a cutting component, the feeding component conveys roll-shaped flexible materials to the cutting component, and the cutting component cuts the flexible materials into the sheet-like flexible materials;

wherein the cutting component comprises:

a clamping groove, for compressing the flexible materials;

a cutter, rotating at a high speed electronically or pneumatically; and a guide rail, the cutter being movably arranged on the guide rail and being able to move along the guide rail in the clamping groove to cut flexible materials obtained after releasing the roll-shaped flexible materials into the sheet-like flexible materials.

2. The device of claim 1, wherein the supplier comprises a turning plate component arranged above the pusher, the sheet-like flexible materials are configured to be attached to the turning plate component, and the sheet-like flexible materials are transferred to the pushing and grasping component by turning down the turning plate component.

3. The device of claim 2, wherein the turning plate component and/or the pushing and grasping component are provided with suction holes for sucking the sheet-like flexible materials.

4. The device of claim 3, wherein the turning plate component and/or the pushing and grasping component are connected with a vacuum component through a pipeline, and the vacuum component provides suction for the turning plate component and/or the pushing and grasping component.

5. The device of claim 2, wherein the turning plate component or the pushing and grasping component is provided with pressing claws, and the pressing claws fix the sheet-like flexible materials on the turning plate component or the pushing and grasping component.

6. The device of claim 2, wherein the turning plate component comprises at least one pair of suction plates capable of moving relatively, and the suction plates are provided with suction holes.

7. The device of claim 6, wherein each said suction plate is provided with a sponge layer or a soft rubber layer on a working surface sucking the sheet-like flexible materials to increase sucking friction of the working surface.

8. The device of claim 2, wherein the turning plate component and the pushing and grasping component are provided with pressing claws, and the pressing claws fix the sheet-like flexible materials on the turning plate component and the pushing and grasping component.

9. The device of claim 1, further comprising:

a bed net assembly, comprising an upper pressing plate and a lower platform, wherein a second gap between the upper pressing plate and the lower platform is configured to clamp the pocket spring bed net, and the pusher pushes the sheet-like flexible materials together with the pocket spring strings compressed by the spring string conveyer to the bed net assembly, so as to form the pocket spring bed net through contact and bonding with each other;

wherein the glue sprayer comprises at least two spray nozzles, at least one of the spray nozzles is arranged between the spring string conveyer and the pusher, and at least one of the spray nozzles is arranged between the bed net assembly and the spring string conveyer.

10. The device of claim 9, wherein the upper pressing plate comprises a first conveyor belt, and the lower platform comprises a second conveyor belt.

11. The device of claim 9, wherein at least one of the spray nozzles is arranged at one side of the spring string conveyer close to the pusher, and when the spring strings conveyed by the spring string conveyer pass through the spray nozzle, glue is sprayed to one side of the spring strings; and at least one of the spray nozzles is arranged at one side of the spring string conveyer close to the bed net assembly, and when the spring strings conveyed by the spring string conveyer pass through the spray nozzle, glue is sprayed to another side of the spring strings.

12. The device of claim 9, wherein at least one of the spray nozzles is arranged at one side of the spring string conveyer close to the pusher, and when the spring strings are input by the spring string conveyer, glue is sprayed to one side of the spring strings; and at least one of the spray nozzles is arranged between the bed net assembly and the spring string conveyer, moves reciprocally in a spring string conveying direction, and sprays glue to a side of the bed net clamped by the bed net assembly.

13. The device of claim 1, wherein the feeding component comprises:

at least two first rotating shafts, wherein at least one of the first rotating shafts outputs power, the roll-shaped flexible materials are placed on two first rotating shafts, the roll-shaped flexible materials are in contact with surfaces of the at least two first rotating shafts, and the first rotating shafts rotate to drive the roll-shaped flexible materials to rotate and release the flexible materials; and at least two second rotating shafts, wherein at least one of the second rotating shafts outputs power, and two second rotating shafts are used for clamping and conveying the released flexible materials.

14. The device of claim 13, wherein the first rotating shaft with power and the second rotating shaft with power are driven by a same motor and have a same linear speed of surface rotation.

* * * * *